US010036357B2

(12) United States Patent
Laws

(10) Patent No.: US 10,036,357 B2
(45) Date of Patent: Jul. 31, 2018

(54) FUEL JET TUBE AND RELATED METHODS

(71) Applicant: TAJM LLC, Howey-in-the-Hills, FL (US)

(72) Inventor: James M Laws, Howey-in-the-Hills, FL (US)

(73) Assignee: TAJM LLC, Howey-in-the-Hills, FL (US)

( * ) Notice: Subject to any disclaimer, the term of this patent is extended or adjusted under 35 U.S.C. 154(b) by 432 days.

(21) Appl. No.: 14/824,844

(22) Filed: Aug. 12, 2015

(65) Prior Publication Data

US 2016/0084411 A1 Mar. 24, 2016

Related U.S. Application Data

(60) Provisional application No. 62/054,151, filed on Sep. 23, 2014.

(51) Int. Cl.
*F02M 55/02* (2006.01)
*F02M 55/00* (2006.01)

(52) U.S. Cl.
CPC ..... *F02M 55/004* (2013.01)

(58) Field of Classification Search
CPC ..... F02M 55/004; F02M 55/02; F16L 15/08
USPC ..... 285/390, 39
See application file for complete search history.

(56) References Cited

U.S. PATENT DOCUMENTS 2,071,478 A * 2/1937 Wick ..... F16L 33/213 285/39
2,784,627 A * 3/1957 Mueller ..... F16L 55/1657 285/39
3,002,769 A * 10/1961 Deubler ..... F16L 27/093 285/39
4,315,603 A * 2/1982 Nakajima ..... F02M 55/004 239/533.3
4,400,024 A * 8/1983 Ratcliff ..... E21B 10/18 285/39
2004/0212193 A1* 10/2004 Johnstone ..... F16L 27/093 285/390
2017/0321642 A1* 11/2017 Autret ..... F02M 55/02

FOREIGN PATENT DOCUMENTS

DE 102008006196 * 7/2009 ..... F02M 55/02

* cited by examiner

*Primary Examiner* — David Bochna
(74) *Attorney, Agent, or Firm* — Mark Malek; Kelly G. Swartz; Widerman Malek, PL

(57) ABSTRACT

A fuel tube system having a tube, a fastening portion, a threaded portion, and a tool connecting surface is presented. The fastening portion is connected to and extends outwardly from the tube. The fastening portion of the fuel tube has an outer diameter larger than the outer diameter of the tube of the fuel tube. The threaded portion is disposed on the outer diameter of the fastening portion. The tool connecting surface is formed in the end of the fastening portion.

8 Claims, 17 Drawing Sheets

FUEL JET TUBE AND RELATED METHODS

RELATED APPLICATIONS

This application is related to and claims benefit under 35 U.S.C. § 119(e) of U.S. Provisional Patent Application Ser. No. 62/054,151 titled FUEL JET TUBE AND RELATED METHODS filed on Sep. 23, 2014, the entire contents of which are incorporated herein by reference.

FIELD OF THE INVENTION

The present invention relates to systems and methods relating to removable fuel jet tubes. In particular, the present invention relates to removable fuel jet tubes for a throttle body.

BACKGROUND OF THE INVENTION

Conventionally, "stake tubes" and/or the port inside a booster are used as the fuel tube between a metering block and a chamber of the carburetor main body. These "stake tubes" are non-removably attached (spin welded, spin riveted, pressed, or glued) to the carburetor main body fuel intake port and then the inside of the stake tube is drilled out to the desired size. If the size needs to change or be adjusted, the carburetor must be replaced or the port in which the stake tube is inserted must be drilled out, a new stake tube spin welded or riveted in and then bored out to the correct size, or the booster assembly must be drilled or replaced. It is also common for the removal of the stake tube to cause damage to the booster assembly, destroying both parts.

The inside port in which the stake tube is fitted has a flat profile which mates with the flat profile of the stake tube to ensure full contact during spin welding. These stake tubes often need to be resized between races. In order to use fuel tubes with different sizes, the carburetor must be sent to a machine shop, the stake tube and/or booster drilled out, and a new stake tube and/or booster added and machined to the desired size. The other option has been for the entire carburetor to be completely replaced.

SUMMARY OF THE INVENTION

An embodiment of the invention, as shown and described by the various figures and accompanying text, provides a system, apparatus and method for utilizing removable fuel jet tubes on a throttle body.

A fuel jet tube with a hollow tube portion and a fastening portion may be placed in the throttle body main body. The fastening portion may include a threaded portion, which may include threads formed so as to mate with an attachment portion on a throttle body at a fuel entry port. It is also possible to use connection configurations other than threads.

In some embodiments, the threads may not extend to the end of the fuel jet tube. Such a configuration may allow the placement of a tool connecting surface on the end of the fuel jet tube. This tool connecting surface may be interfaced with a tool so as to facilitate attachment and detachment of the fuel jet tube to the throttle body main body.

The fuel jet tube may have a constant inner diameter. In some embodiments, the inner diameter of the fuel jet tube may vary along the length thereof to alter flow characteristics as desired.

The outer diameter of the tube portion may be constant from the connection to the fastening portion to the distal end of the fuel jet tube. In some embodiments, the hollow tube portion may have different outer diameters at different portions along the hollow tube portion.

The fuel jet tube may be machined prior to installing it in the throttle body. This may provide a wider variety of machining options compared to the prior art. In particular, the inner diameter and the shape of the fuel jet tube may be machined to higher tolerances than the previously used stake tubes. This enhanced precision may allow for finer fuel flow adjustment.

The fuel jet tube may have an abutment face where the outer diameter of the fuel jet tube decreases. This may be where the fastening portion joins the tube portion. This may allow the jet fuel tube to form a seal with the throttle body main body.

The fuel jet tube may be removably attached to a fuel entry port in the throttle body main body. The fuel entry port may include an outer surface and an attachment surface that allows the fastening portion of the fuel jet tube to be removably mated to the fuel entry port. The fuel entry port may also include an abutment surface that contacts the abutment face on the fuel jet tube.

The fuel entry port may have a space which can accommodate an O-ring, or other seal-forming member, between the throttle body main body and a portion of the outer periphery of the fuel jet tube.

The fuel jet tube may have one or more holes located in the hollow tube portion. The diameters of each hole may be uniform, or one or more holes may have a diameter that is not equal to the diameter of another hole. These holes may have any shape and may be spaced symmetrically or asymmetrically from one another. In embodiments with holes, the end face may be sealed, or partially sealed, so as to force the fuel out of the holes.

An end of the fuel jet tube may be angled, which may promote smooth fuel flow or direct fuel in a certain direction within the chamber into which the fuel jet tube is inserted.

The fuel jet tube may include an alignment marker, which may be aligned with a corresponding alignment marker on the throttle body main body to ensure proper orientation of the fuel jet tube within a chamber disposed within the throttle body main body.

A tool connecting surface may be disposed on an end of the fastening portion. The tool connecting surface may be formed of one or more grooves. The grooves may mate with protrusions on a tool used for fastening and unfastening the fuel jet tube.

These features, and in particular the removable nature of the fuel jet tube and subsequent ability to quickly change out the fuel jet tubes based on the desired properties, are a large improvement over the conventional stake tube. For example, with exemplary embodiments of the present invention, race cars may have the diameters of their fuel jet tubes changed just minutes before a race in order to adjust for atmospheric conditions, track conditions, other environmental factors, strategy, and/or the user's preference/strategy.

Despite carburetors and electronic fuel injection systems having been in use for decades, the above exemplary advantages are simply not possible with the conventional stake tubes and methods of changing the stake tube type fuel jets. Indeed, all conventional means of changing the characteristics of a stake tube fuel tube require removal of the throttle body main body, multiple machining steps, and the destruction of the stake tube fuel tube and possibly the destruction of the booster.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides a system, apparatus and method for utilizing removable fuel jet tubes on a throttle body.

Figure 1:
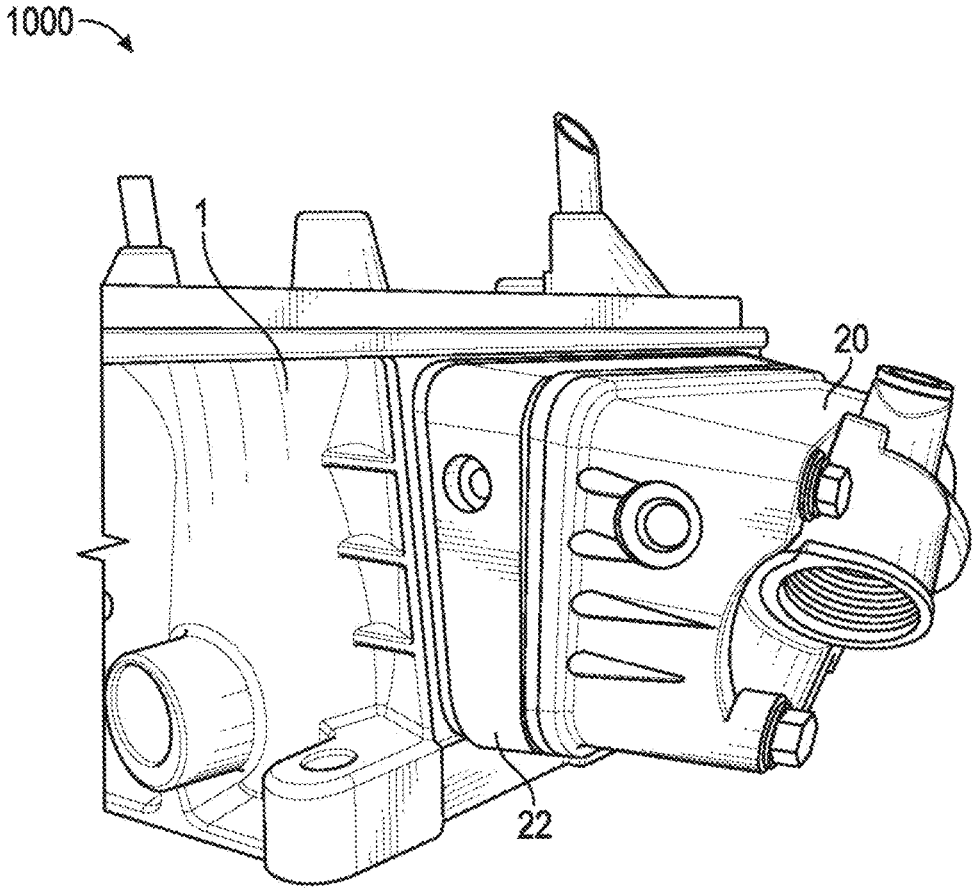
FIG. 1 is a partial perspective view of a throttle body showing a fuel jet tube being installed therein according to an embodiment of the present invention.
Figure 2:
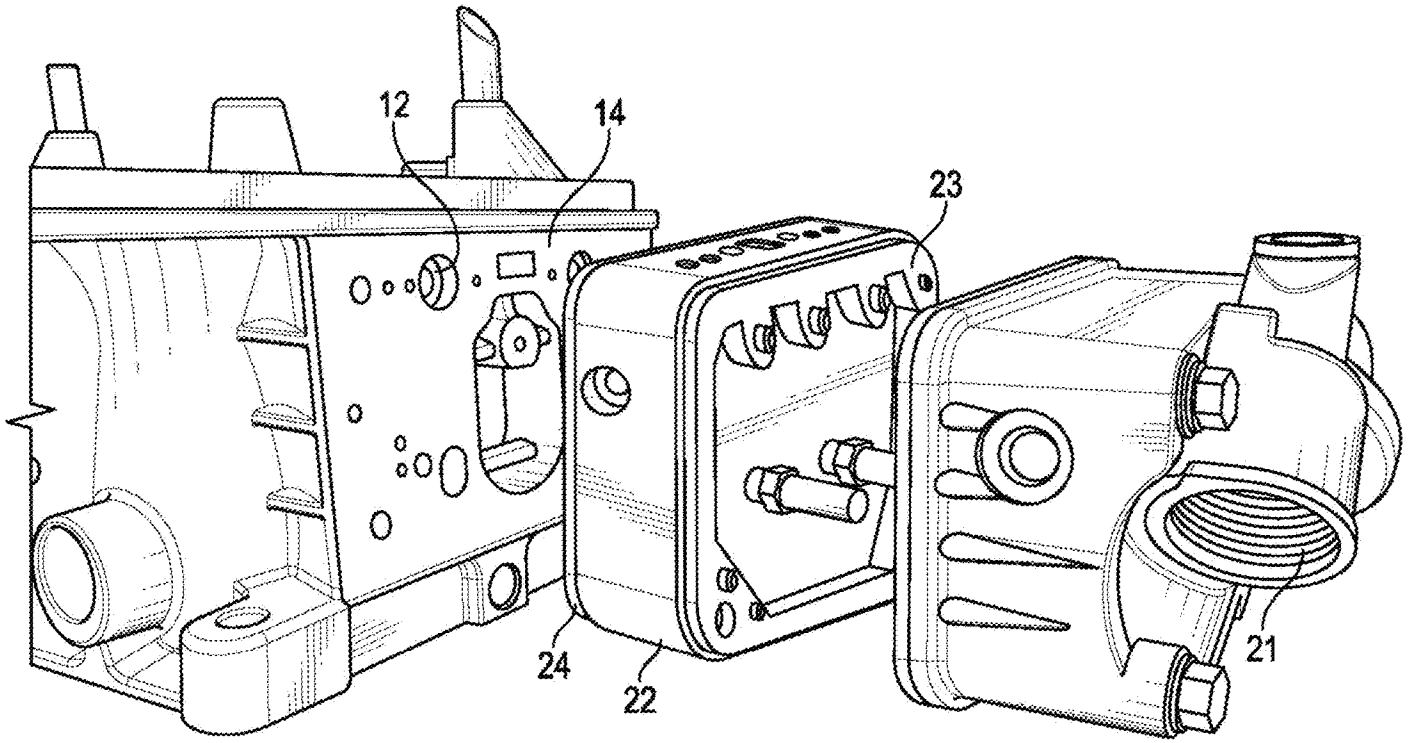
FIG. 2 shows a partial exploded perspective view of the throttle body illustrated in FIG. 1.
Figure 3:
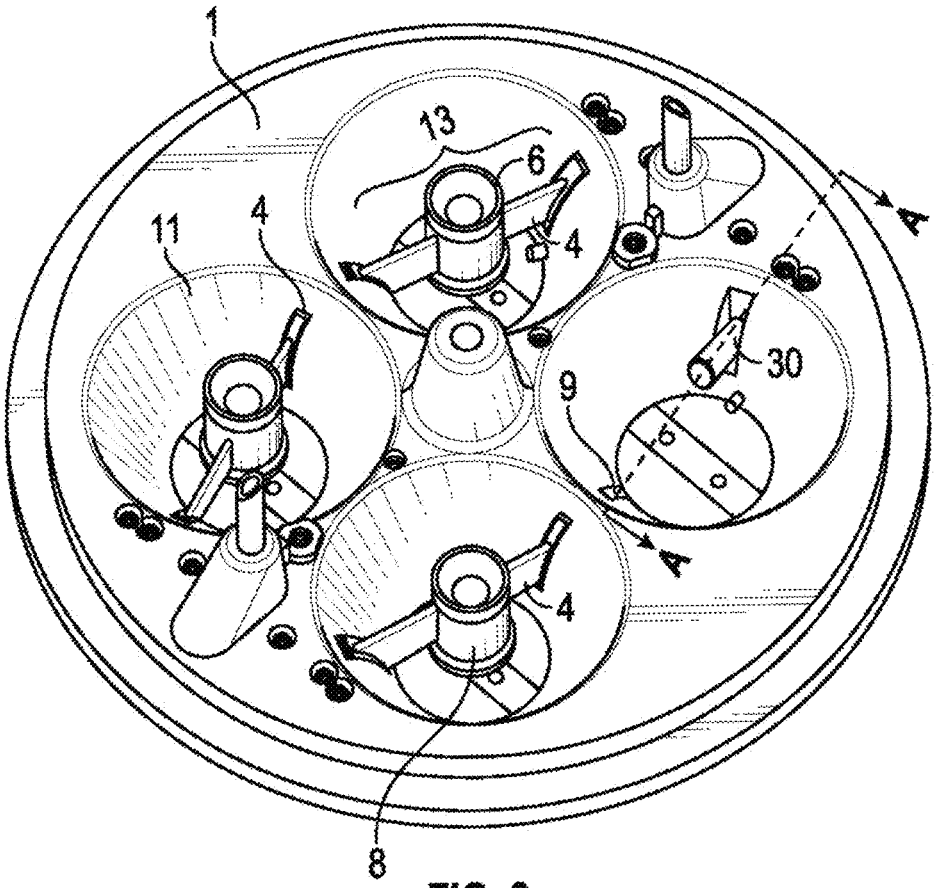
FIG. 3 is a perspective view of a portion of the throttle body illustrated in FIG. 1.
Figure 4:
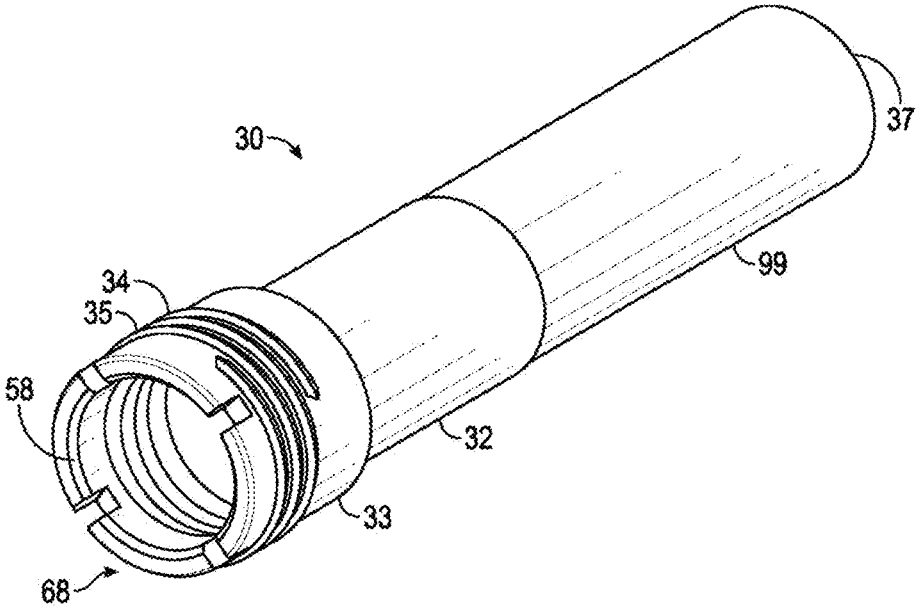
FIG. 4 is a perspective view of an embodiment of a fuel jet tube according to an embodiment of the present invention.
Figure 5:
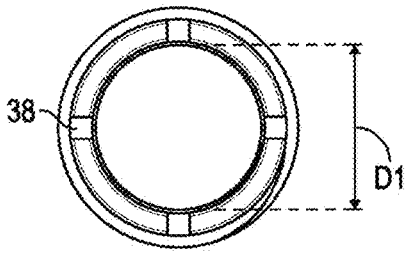
FIG. 5 is a front elevation view of the fuel jet tube illustrated in FIG. 4.
Figure 6:
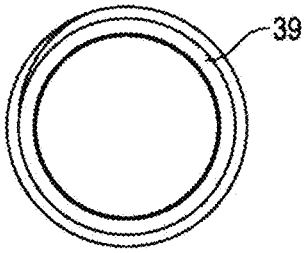
FIG. 6 is a rear elevation view of the fuel jet tube illustrated in FIG. 4.
Figure 7:
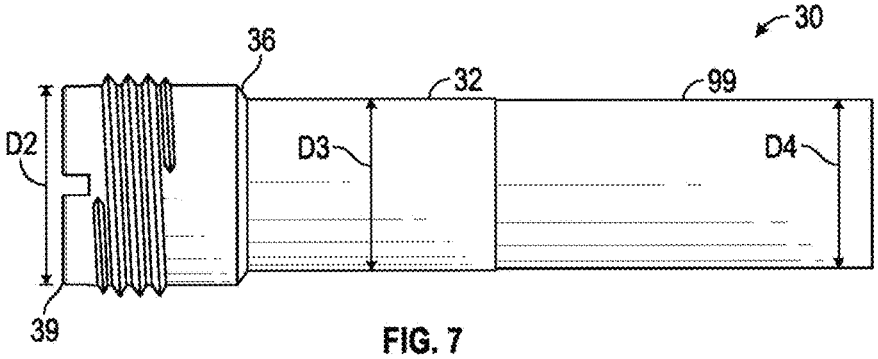
FIG. 7 is a side elevation view of the fuel jet tube illustrated in FIG. 4.

FIGS. 1-3 illustrate a throttle body assembly 1000 (e.g., a carburetor assembly or electronic fuel injection throttle body) including a throttle body main body 1 and a fuel bowl assembly 20 according to an embodiment of the invention. The fuel bowl assembly 20 may include a fuel inlet 21, a metering block 22, a gasket 23 located between the fuel inlet 21 and the metering block 22, and another gasket 24 located between the metering block 22 and the throttle body main body's metering block mounting face 14. However, the particular design and components making up the fuel bowl assembly 20 and the carburetor 1000 are not particularly limited. In addition, it is noted that a carburetor is illustrated for consistency and ease of understanding. However, the fuel jet tube 30 is also applicable to electronic fuel injection throttle bodies.

In the throttle body main body 1 are one or more chambers 11. The chamber 11 may be configured to have fuel dispersed there into through the fuel jet tube. In the present embodiment, the throttle body main body 1 comprises four chambers 11. Any number of chambers 11 is contemplated and included within the scope of the invention. In some embodiments, the dispersion may be accomplished by a dispersion device. The dispersion device may be the fuel jet tube 30 or a separate diffusion member such as a booster assembly 13.

In the present embodiment, during normal operation of the throttle body, fuel leaves the metering block 22 at an exit port and enters the throttle body main body 1 at fuel entry port 12. The fuel jet tube 30 may be disposed in the fuel entry port 12 such that the fuel flows through the fuel jet tube 30 into the chamber 11, either directly or through an intermediate dispersing member, such as the booster assembly 13. The fuel jet tube 30 may be dimensioned with a length that extends into the chamber 11 and, if present, into the booster assembly 13. The booster assembly 13 may be connected to the throttle body main body 1 at a connecting portion such as slot(s) 9, into which a portion of the booster assembly 13 may fit. The booster assembly 13 may include a separate booster main body 8 and a dispersion insert 6. The booster main body 8 and dispersion insert 6 may be integrally formed as a monolithic unit, or may be provided by separate components and/or subcomponents. In addition, the booster assembly 13 may have an H-shape having two columns 4 extending outwardly from a medial outer surface of the booster main body 8, or a single column 4 on one side of the booster main body 8, or any other appropriate shape. In some embodiments, the fuel jet tube 30 may be dimensioned so as to fit inside a column 4 of the booster assembly 13 so as to deliver fuel through booster assembly into the chamber 11.

FIGS. 4-7 illustrate a fuel jet tube 30 according to an embodiment of the invention. The fuel jet tube 30 may include a hollow tube 32 and a fastening portion 33 which is configured to hold the fuel jet tube 30 into place in the throttle body main body 1. The fastening portion 33 may include a threaded portion 34. The threaded portion 34 may include threads 35 formed so as to mate with an attachment portion 102 (e.g., threads) on a portion of a throttle body 1 at the fuel entry port 12. In some embodiments, the threads 35 may not extend to the end of the fastening portion 33 which is closest to the distal end of the fuel jet tube 30. This may provide increased structural integrity for the threads 35.

While FIGS. 4-10 illustrate an embodiment using threaded fastening to attach the fuel jet tube 30 to the throttle body main body, other methods of attachment are contemplated and included within the scope of the invention, including, but not limited to, latches, interference fits, welding, C-clips, adhesives, and any other appropriate method.

It is also possible to use different attachable/detachable attachment schemes. For example, fastening portion 33 may include a fastening groove configured to hold a C-clip, or other fastener. The throttle body may also have a groove which can accept the C-clip. In addition, the throttle body main body may also have an access portion configured so as to provide access to the C-clip. Thus, the clip may be removed to allow change out of the fuel jet tube 30.

In some embodiments, threads 35 may not extend to a proximal end 68 of fuel jet tube 30. This may allow the placement of a tool connecting surface, such as grooves 38, which can be interfaced with a tool so as to precipitate attachment and detachment of the fuel jet tube 30 to the throttle body main body 1. While shown as four grooves 38 in exemplary FIG. 4, any number of grooves 38 may be used. Indeed, any appropriate tool mating surface may be used so as to enable the attachment of fuel jet tube 30.

The proximal end 68 of the fuel jet tube 30 may also include an inclined surface 58, which may promote smooth fuel flow.

In some embodiments, the fuel jet tube 30 may have a constant inner diameter D1. In some embodiments, the inner diameter D1 of the fuel jet tube 30 may be constant along an entirety thereof to promote certain flow characteristics (e.g., laminar flow). However, in other embodiments, the inner diameter D1 of the fuel jet tube 30 may vary along the length thereof to provide certain flow characteristics as desired.

The outer diameter D3 of the hollow tube portion 32 may be constant from the end of the abutment face 36 to the distal end of the fuel jet tube 30. However, in some embodiments, the outer diameter D3 of the hollow tube portion 32 may vary depending on the application and the desired characteristics. By way of example, the outer diameter D3 of the hollow tube portion 32 may increase or decrease to a different outer diameter D4 at a distal hollow tube portion 99.

Since the fuel jet tube 30 may be machined prior to installing in the throttle body, the machining options are greater. In particular, the inner diameter D1 and the shape of the fuel jet tube 30 may be machined to higher tolerances than the previously used stake tubes. Thus, the thickness of tube wall 39 can be more precise and thinner and the inner diameter D1 may be more precise and/or constant, which may allow finer fuel flow adjustment. The machining methods discussed herein are for example only, and all other methods of machining the fuel jet tube 30 as are known in the art are contemplated and included within the scope of the invention.

In some embodiments, the fuel jet tube 30 may have a flat distal end face 37. The distal end of fuel jet tube 30 may extend into the chamber 11 within the booster assembly 13. That is, in some embodiments, the fuel jet tube 30 will be inside of the booster assembly 13 while in the chamber 11. The booster assembly 13 may have a dispersion insert 6 attached thereto. In such embodiments, fuel may be directed through the dispersion insert 6 after leaving the fuel jet tube 30. The length of the hollow tube portion 32 of fuel jet tube 30 may be configured based on the booster assembly 13, or other connecting members, with which the hollow tube portion 32 will interact.

The fuel jet tube 30 may be made of brass, steel, aluminum, or any other suitable material for use with a material of which the throttle body main body 1 is formed. Such materials include, but are not limited to, metals, metal alloys, polymers, composite materials, and the like.

The fuel jet tube 30 may also have an abutment face 36 where the outer diameter of the fuel jet tube 30 decreases. In some embodiments, the abutment face 36 may be located between the threaded portion 34 of the fastening portion 33 and the distal end of the fuel jet tube 30 which is inserted into the chamber 11. A portion of the abutment face 36 may have an outer diameter D2 which is equal to, or substantially equal to, an inner diameter of the fuel entry port 12 where the abutment face 36 may contact the throttle body main body 1 in an installed state. This may allow the abutment face 36 to form a seal between the fuel jet tube 30 and the throttle body main body 1. The seal formed there between may be sufficient to prevent the flow of fluid there through. The abutment face 36 may be sloped such that the outer diameter of the abutment face 36 decreases linearly over a distance, non-linearly over a distance, exponentially over a distance, or any combination thereof. Furthermore, the abutment face 36 may be configured to facilitate the disposal of a material thereupon configured to facilitate the forming of a seal between the fuel jet tube 30 and the throttle body main body 1.

Figure 8:
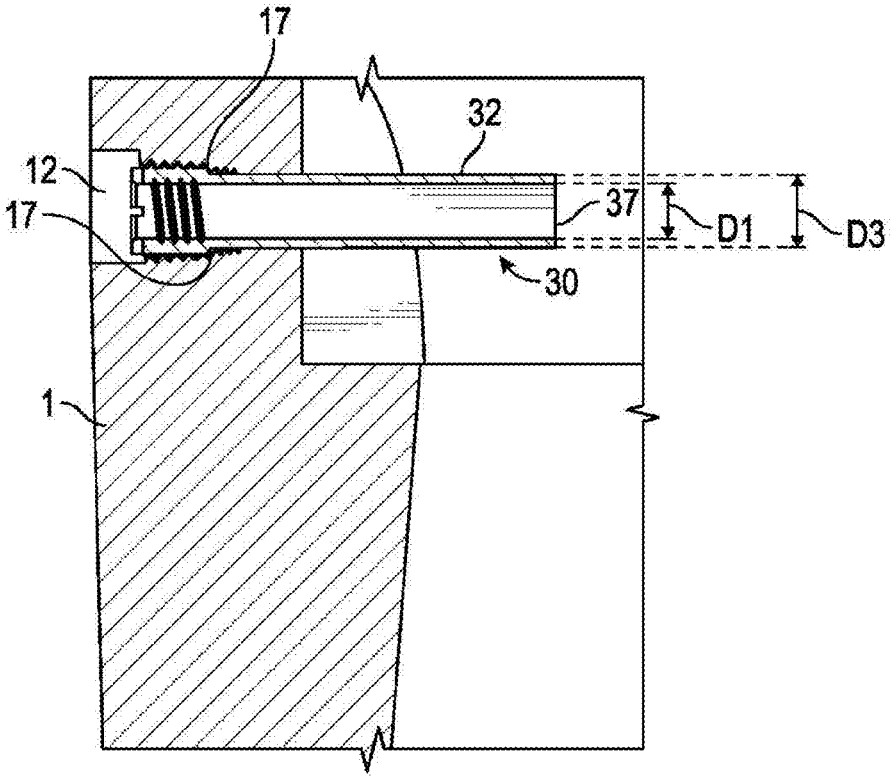
FIG. 8 is a cross sectional view of a portion of the throttle body taken through line A-A in FIG. 3 and showing the fuel jet tube installed.
Figure 9:
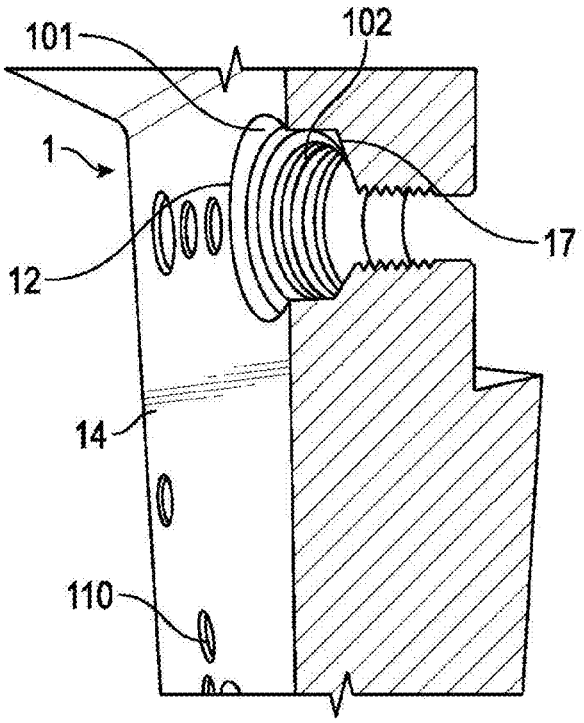
FIG. 9 is a perspective cross sectional view of a portion of the throttle body taken through line A-A in FIG. 3 with the fuel jet tube absent.

As shown in FIGS. 8-9, the throttle body main body 1 may include a fuel entry port 12, in which the fuel jet tube 30 may be removably attached. The fuel entry port 12 may include an outer surface 101 and an attachment surface 102 formed so as to allow the fastening portion 33 of the fuel jet tube 30 to be removably mated. In some embodiments, the attachment surface 102 includes threads which correspond to and enable attachment by the threads of fastening portion 33. The fuel entry port 12 may also include an abutment surface 17. In some embodiments, the abutment surface 17 may be located between the attachment surface 101 and a tube accommodation surface, in which a portion of the hollow tube 32 fits. FIG. 9 shows the throttle body main body 1 with the fuel jet tube 30 absent (e.g., before attachment or after removal of the fuel jet tube 30).

The abutment surface 17 in the throttle body 1 may have a surface with an inner diameter equal to or less than the maximum diameter of the abutment face 36. In some embodiments, the abutment surface 17 may have a diameter less than that of the abutment face 36 to ensure a tight seal. The abutment surface 17 may have a ridge shape, and/or the abutment surface 17 may have a surface which is sloped at the same or different angle as that of the abutment face 36.

In some embodiments, using a ridge or sloping shape which does not match the shape of the abutment face 36 may allow a seal to be formed at a set circumference of the abutment face 36. This may reduce the machining requirements for the abutment surface 17. For instance, by using a slightly non-matching profile, it may enable the abutment face 36 to contact the throttle body main body around a circumference of the abutment face 36, such that only a portion of the abutment face 36 needs to contact the abutment surface 17. This may be useful as the shaping method for the abutment face 36, in some instances, may be more precise than the shaping methods available for the abutment surface 17 (e.g., drilling out the abutment surface 17 versus using a precision lathe for the abutment face 36). In other embodiments, the precision for forming the abutment face 36 and the abutment surface 17 may be approximately the same (e.g., both made with an automated machining tool). The shaping methods discussed herein are for example only, and all other methods of shaping each of the abutment surface 17 and the abutment face 36 as are known in the art are contemplated and included within the scope of the invention.

Figure 10:
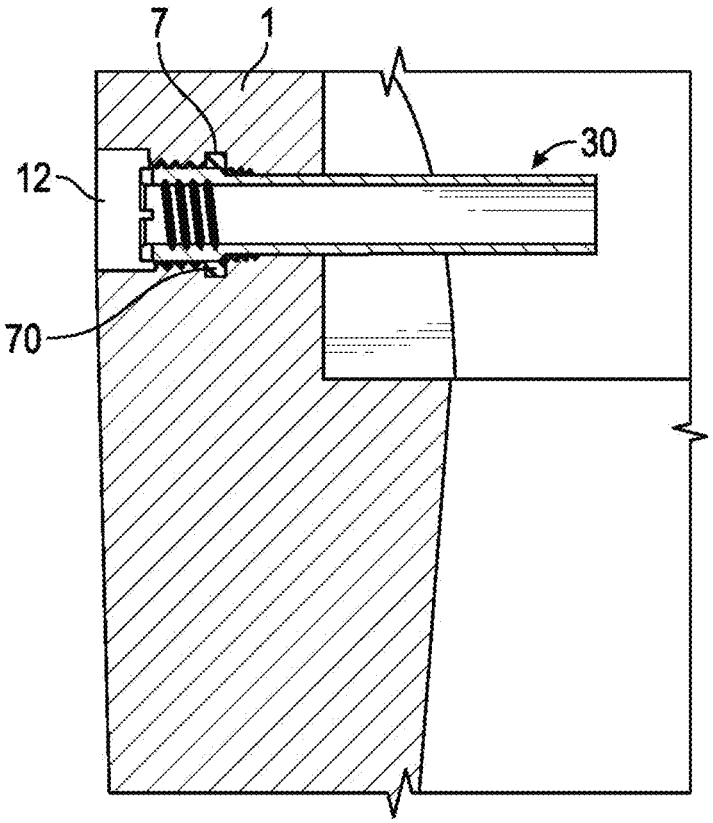
FIG. 10 is an a cross sectional view of a portion of the throttle body taken through line A-A in FIG. 3 and including an O-ring.

In some embodiments, as illustrated in FIG. 10, the fuel entry port 12 may have a space 7 which can accommodate an O-ring 70 or other seal-forming member, such as gaskets, between the throttle body main body 1 and a portion of the outer periphery of the fuel jet tube 30. In some embodiments, the O-ring 70 may be positioned between the abutment face 36 and the abutment surface 17. In some embodiments, the abutment face 36 may be a flat ridge perpendicular to the axis of the fuel jet tube 30.

As illustrated in FIGS. 11A-13, the fuel jet tube 30 may be used without a separate diffusing member, and instead be exposed to the chamber 11. This may allow the use of fewer parts, and provide the ability to change the diffusion characteristics for a chamber 11 without the need for replacing an additional member.

Figure 11A:
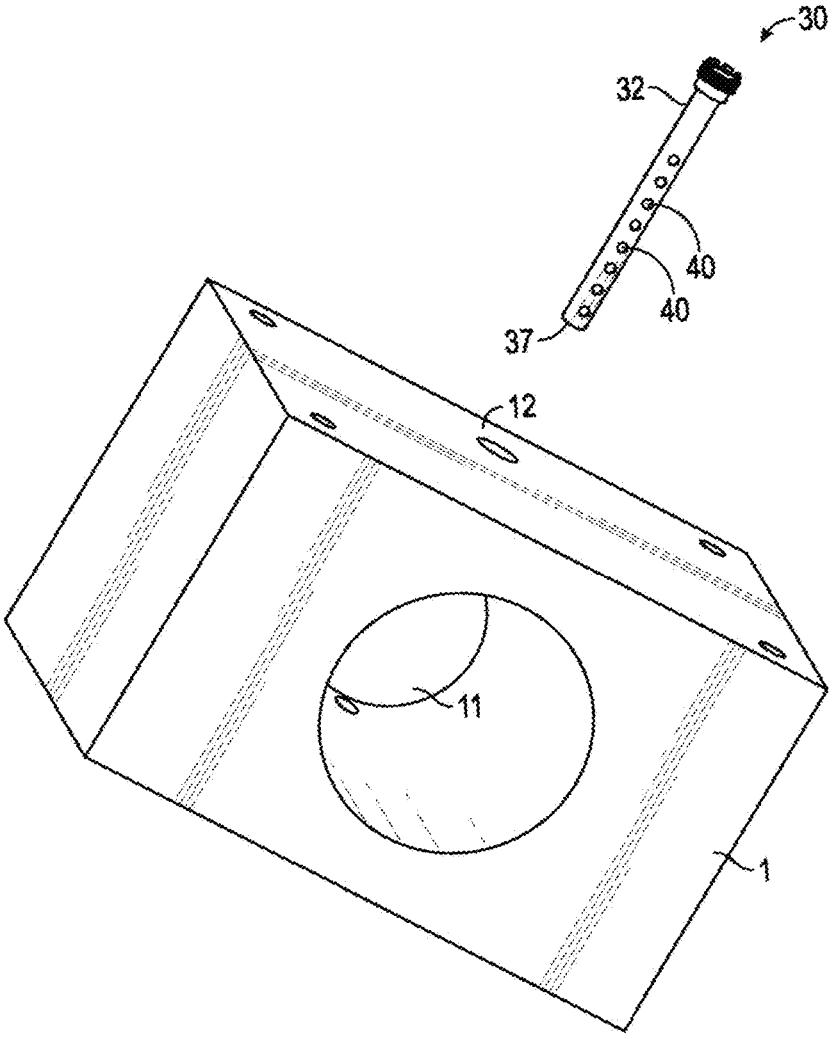
FIG. 11*a* is an exploded perspective view of a main body and a fuel jet tube of a throttle body according to an embodiment of the present invention.
Figure 11B:
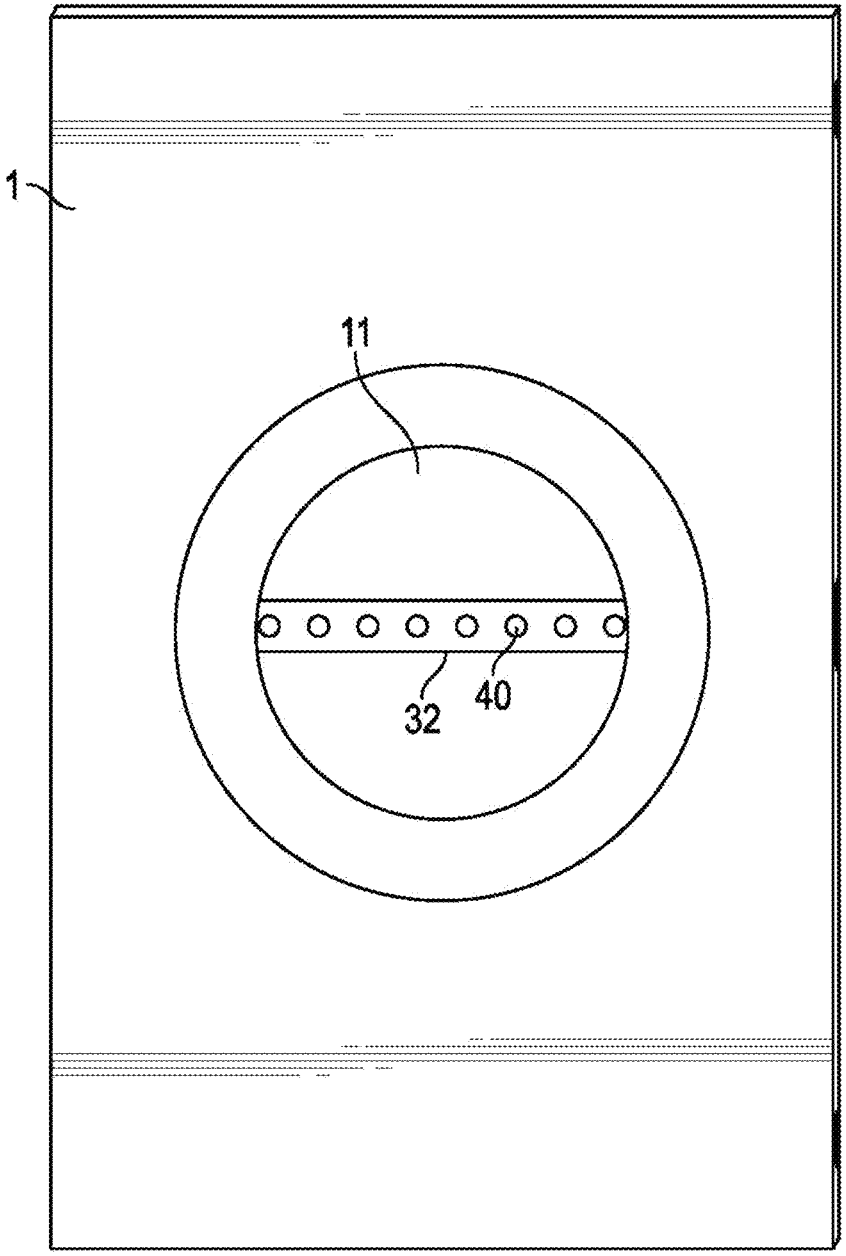
FIG. 11*b* is a bottom plan view of the throttle body main body illustrated in FIG. 11*a* and showing the fuel jet tube being inserted into a portion of the throttle body main body.

In some embodiments, as illustrated in FIGS. 11A and 11B, fuel jet tube 30 may have one or more holes 40 located in the hollow tube portion 32. The number of holes 40 is not particularly limited. Furthermore, the diameter of each hole 40 may be uniform for each hole 40, or one or more holes 40 may have a diameter that is not equal to the diameter of another hole 40. In addition, holes 40 may have any shape, such as a slot, triangle, asymmetrical, etc. Holes 40 may be spaced symmetrically or be spaced asymmetrically from one another.

The holes 40 may be located in a single line parallel to the axial direction of the hollow tube 32. These holes may face the same direction, or may be shaped so as to face, or project fuel, in different directions. In some embodiments, the holes 40 may be disposed so as to face different directions and/or may be located in positions so as to not form a single line along the axis of the hollow tube 32.

The end face 37 may be sealed, or partially sealed, so as to force the fuel out of holes 40 and not out of any of, or out of just a portion of, the end face 37, as desired.

Figure 12:
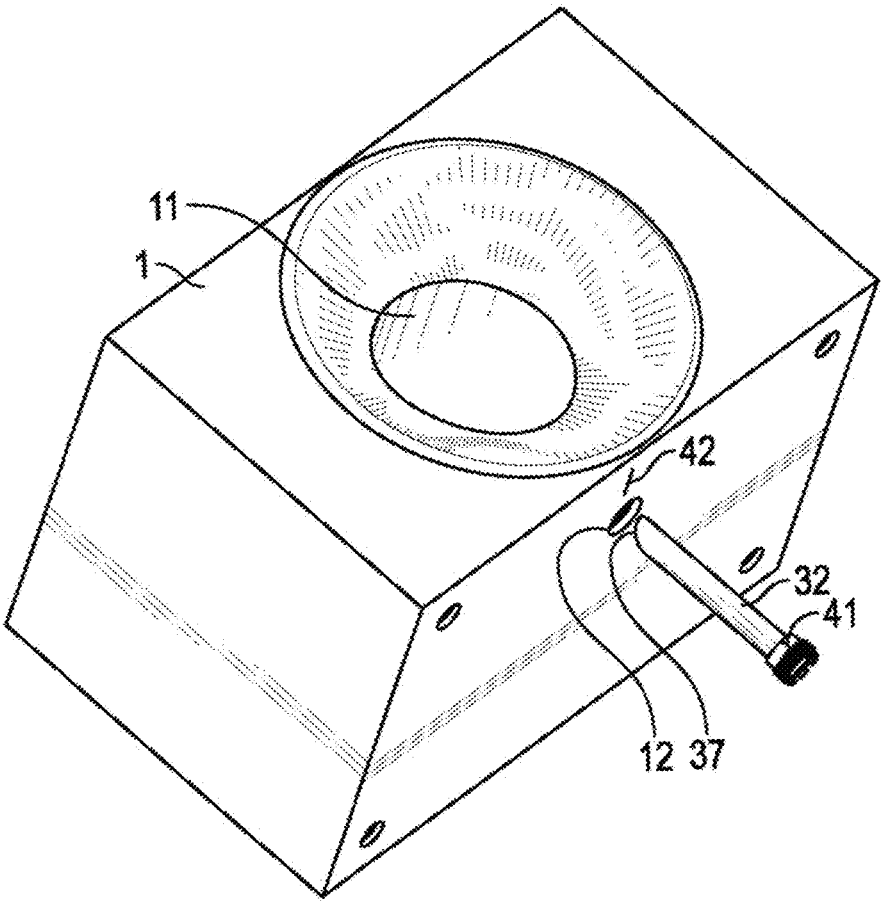
FIG. 12 is an exploded perspective view of the throttle body main body and a fuel jet tube of a throttle body according to an embodiment of the present invention.
Figure 13:
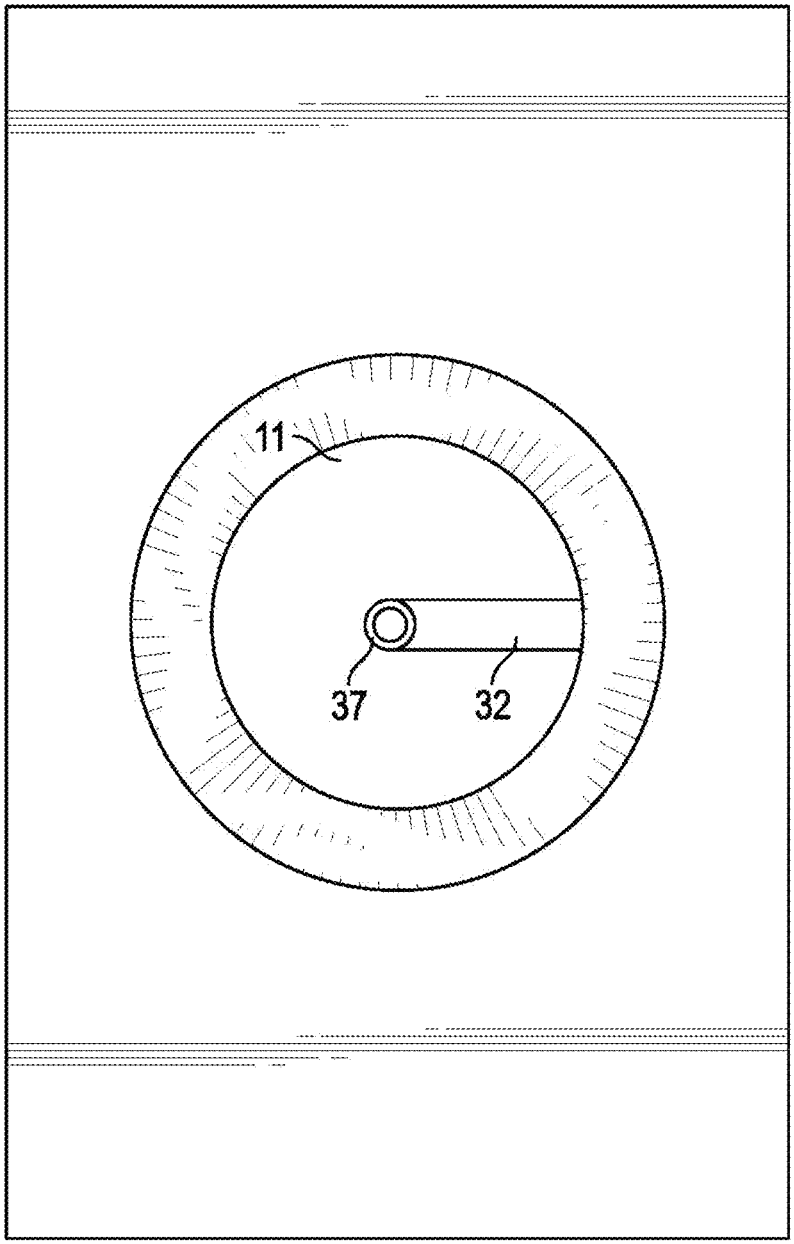
FIG. 13 is a bottom plan view of the throttle body main body illustrated in FIG. 12, and showing the fuel jet tube being inserted into a portion of the throttle body main body.
Figure 14:
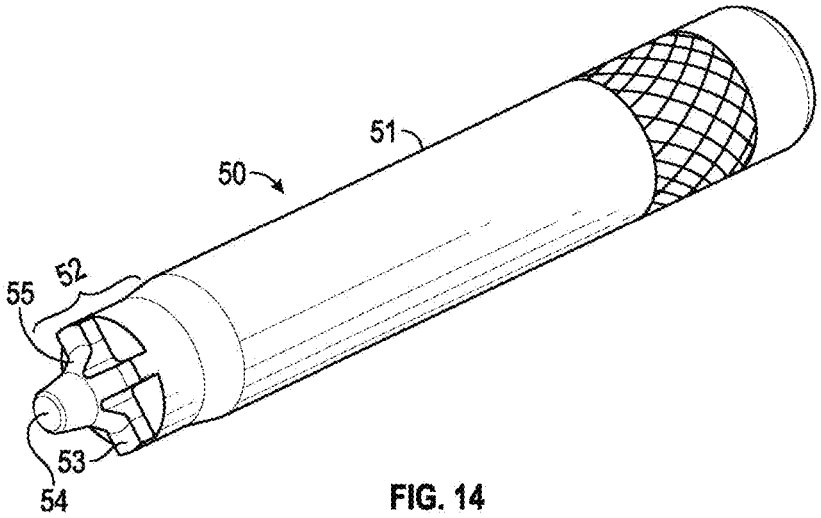
FIG. 14 is a perspective view of an attachment tool used in connection with installing and removing a fuel jet tube into a throttle body main body according to an embodiment of the invention.

In addition, the end face 37 may also be angled relative to a longitudinal axis of the hollow tube 32 or shaped so as to direct fuel in a certain direction within the chamber 11. For instance, as illustrated in FIGS. 12 and 13, the fuel jet tube 30 may have a face with a slope angled at forty five degrees to the longitudinal axis of the hollow tube 32. However, the angle and shape of the end face 37 may be varied depending on the desired fuel dispersion characteristics, such as having a thirty degree angle or a downward pinched area on the top of the end face 37, or any other angle and/or shape combination. In addition, the length which the hollow tube portion 32 extends into the chamber (e.g., how far across the chamber 11 the fuel jet tube 30 extends) may be adjusted depending on the holes 40, the end face 37 shape or other considerations.

In some embodiments, the features of FIGS. 11A and 12 may be combined, such as a hollow tube 32 with both holes 40 and an angled end face 37, depending on the dispersion characteristics desired by the user.

Indeed, any of the fuel jet tube 30 characteristics (diameter, shape, exit hole(s) characteristics, etc.), or combinations thereof, may be altered to adjust the dispersion characteristics of fuel into chamber 11.

In some embodiments, where the fuel jet tube 30 includes the diffusion portion (e.g., holes 40 and/or a slanted end face 37), the fuel jet tube 30 also may include an alignment mark 41. The alignment mark 41 may include a printed line, a groove, a raised portion, or any other suitable marker. The throttle body main body 1 may also include an alignment marker 42. Thus, the two alignment markers 41 and 42 can be aligned so that, when the fuel jet tube 30 is threaded or otherwise attached to the throttle body main body 1, the holes 40 and/or shaped end face 37 have the correct orientation in chamber 11.

A tool for fastening and unfastening the fuel jet tube 30 according to an embodiment of the invention is illustrated in FIGS. 14-17. A fastening tool 50 may include a shaft 51 and an engagement portion 52 which is configured to engage with a tool connecting surface, such as grooves 38 on fuel jet tube 30. The engagement portion 52 may include one or more protrusions 53, arranged to correspond to, for example, grooves 38. The engagement portion 52 may also include an insertion portion 54, which may include a projection in the axial direction configured to fit into the inside diameter of the fastening portion 33. The engagement portion 52 may also include a sloped surface 55, to further promote proper positioning of the protrusions 53 into grooves 38. Once the fastening tool 50 is mated with the engagement portion 52, the fuel jet tube 30 may be secured to the throttle body main body 1 (e.g., screwed in) or unsecured from the throttle body main body 1 (e.g., unscrewed).

Figure 15:
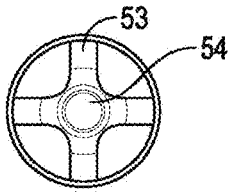
FIG. 15 is a front elevation view of the attachment tool illustrated in FIG. 14.
Figure 16:
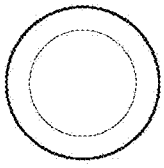
FIG. 16 is a rear elevation view of the attachment tool illustrated in FIG. 14.
Figure 17:
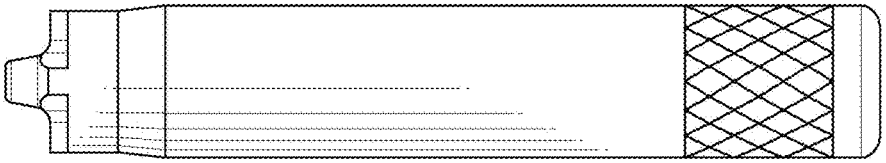
FIG. 17 is a side elevation view of the attachment tool illustrated in FIG. 14.

Although FIG. 15 illustrates an embodiment having four evenly spaced protrusions 53 to match the illustrated grooves 38 in the proximal end face of the fuel jet tube 30, the fastening tool 50 and grooves 38 is not limited to such a configuration. For instance, the grooves 38 may be of any shape, number, and/or distribution and the fastening tool 50 can be made to complement the grooves 38 in whole or in part (e.g., two protrusions 53 to mate with a fuel jet tube 30 having two grooves 38).

Figure 18:
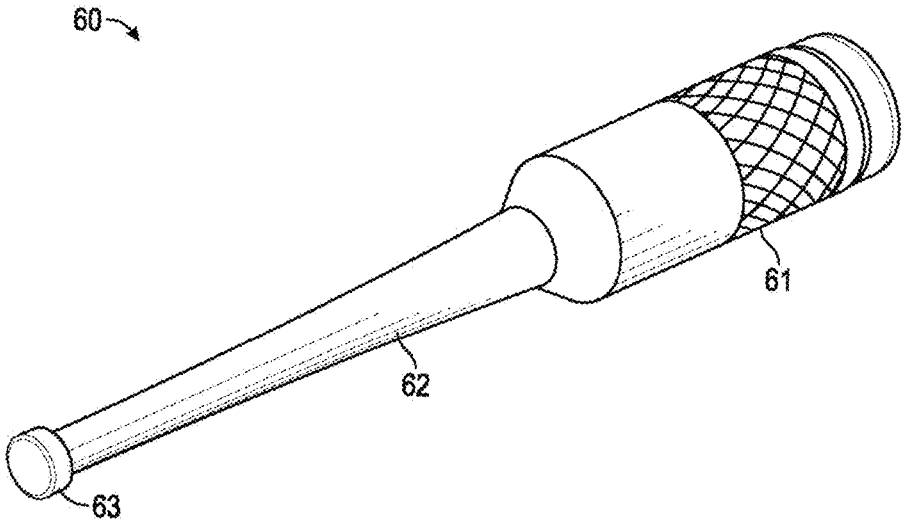
FIG. 18 is a perspective view of an extraction tool used to extract a fuel jet tube from the throttle body main body according to an embodiment of the invention.
Figure 19:
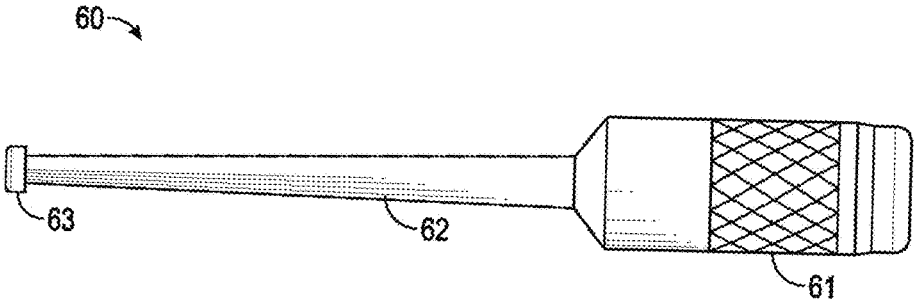
FIG. 19 shows a side view of the extraction tool of FIG. 18.

A tool for extracting the fuel jet tube 30 according to an embodiment of the invention is illustrated in FIGS. 18 and 19. As can be seen in FIG. 18, the extraction tool 60 may include a handle portion 61 and a shaft portion 62, the shaft portion 62 having an outer diameter less than an inner diameter of the fuel jet tube 30. On a distal end of the shaft portion 62 may be an engaging portion 63, such as a ridge which extends radially outward from the shaft portion 62. The extraction tool 60 may be inserted inside a disengaged fuel jet tube 30. The end face 37 of the fuel jet tube 30 may then interface with and be caught by engaging portion 63 and the fuel jet tube 30 may be pulled out of the throttle body main body 1.

In some embodiments, the fuel jet tubes 30 may come in a variety of inner diameters D1. For example, the fuel jet tubes 30 may be provided in $1/1000^{th}$ inch increments, or other appropriate size variations, and/or with different dispersion characteristics (e.g., the holes 40 in hollow tube 32 or no holes 40 for use with a booster assembly 13). Therefore, the inner diameter D1 of each of the fuel jet tubes 30 of a throttle body assembly 1000 may be changed independently without the need to machine the throttle body main body 1.

These features, and in particular the removable nature of the fuel jet tube 30 and subsequent ability to change out the fuel jet tubes 30 based on the desired properties, are a large improvement over the conventional stake tube. For example, with exemplary embodiments of the present invention, race cars may have the diameters of their fuel jet tubes 30 changed just minutes before a race in order to adjust for atmospheric conditions, track conditions, other environmental factors, strategy, and/or the user's preference/strategy.

Despite carburetors and electronic fuel injection systems having been in use for decades, the above exemplary advantages are simply not possible with the conventional stake tubes and methods of changing the stake tube type fuel jets. Indeed, all conventional means of changing the characteristics of a stake tube fuel tube require removal of the throttle body main body, multiple machining steps, and the destruction of the stake tube fuel tube and possibly the destruction of the booster.

Figure 20:
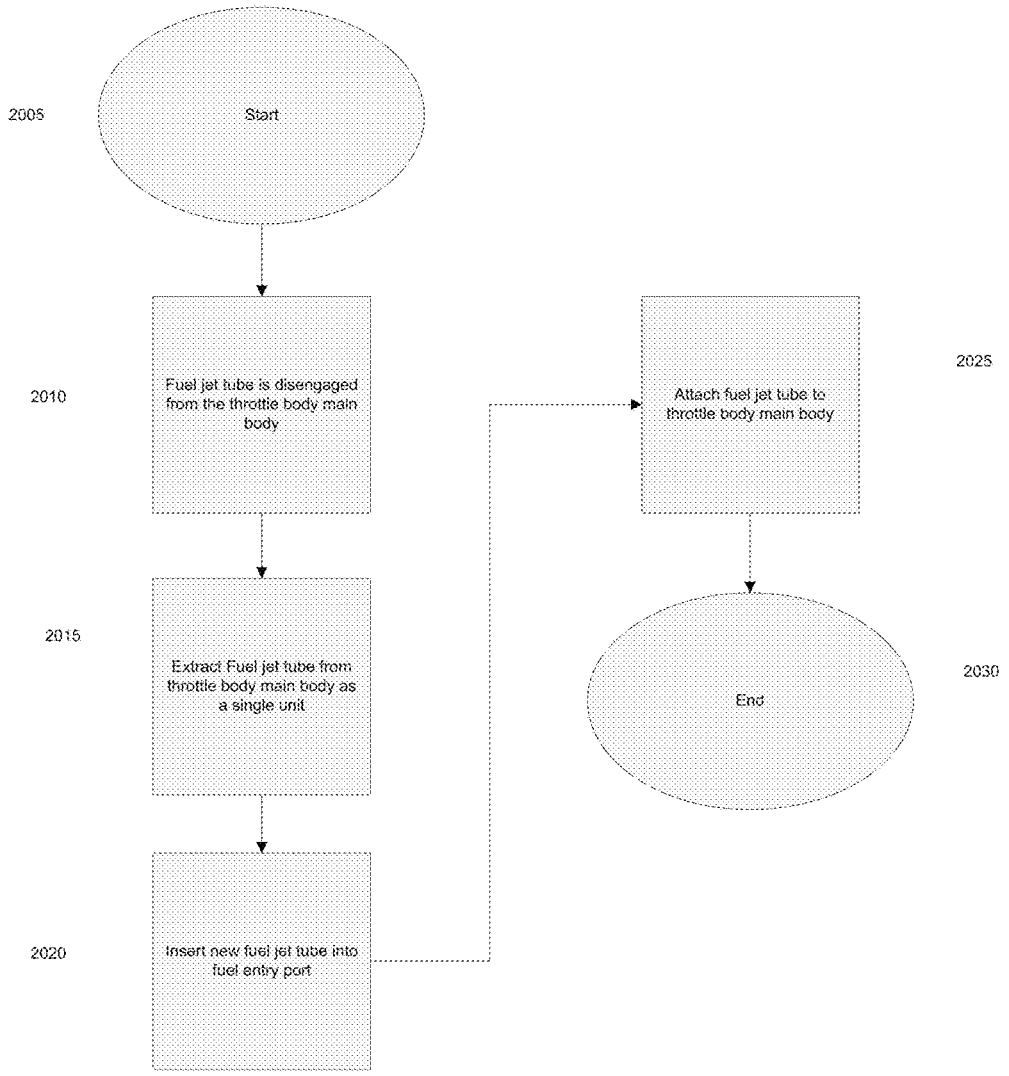
FIG. 20 is a flow chart illustrating a method of changing a fuel jet tube in a throttle body according to an embodiment of the present invention.

A method for changing a fuel jet tube according to an embodiment of the invention is illustrated in FIG. 20. The method starts at block 2005. The fuel jet tube is then disengaged from the throttle body at block 2010. At block 2015, the fuel jet tube is extracted from the throttle body as a single unit. At block 2020, a new fuel jet tube is inserted into the fuel entry port. The new fuel jet tube is then attached to the throttle body main body, through the use of the fastening portion at block 2025. The method ends at block 2030.

Figure 21:
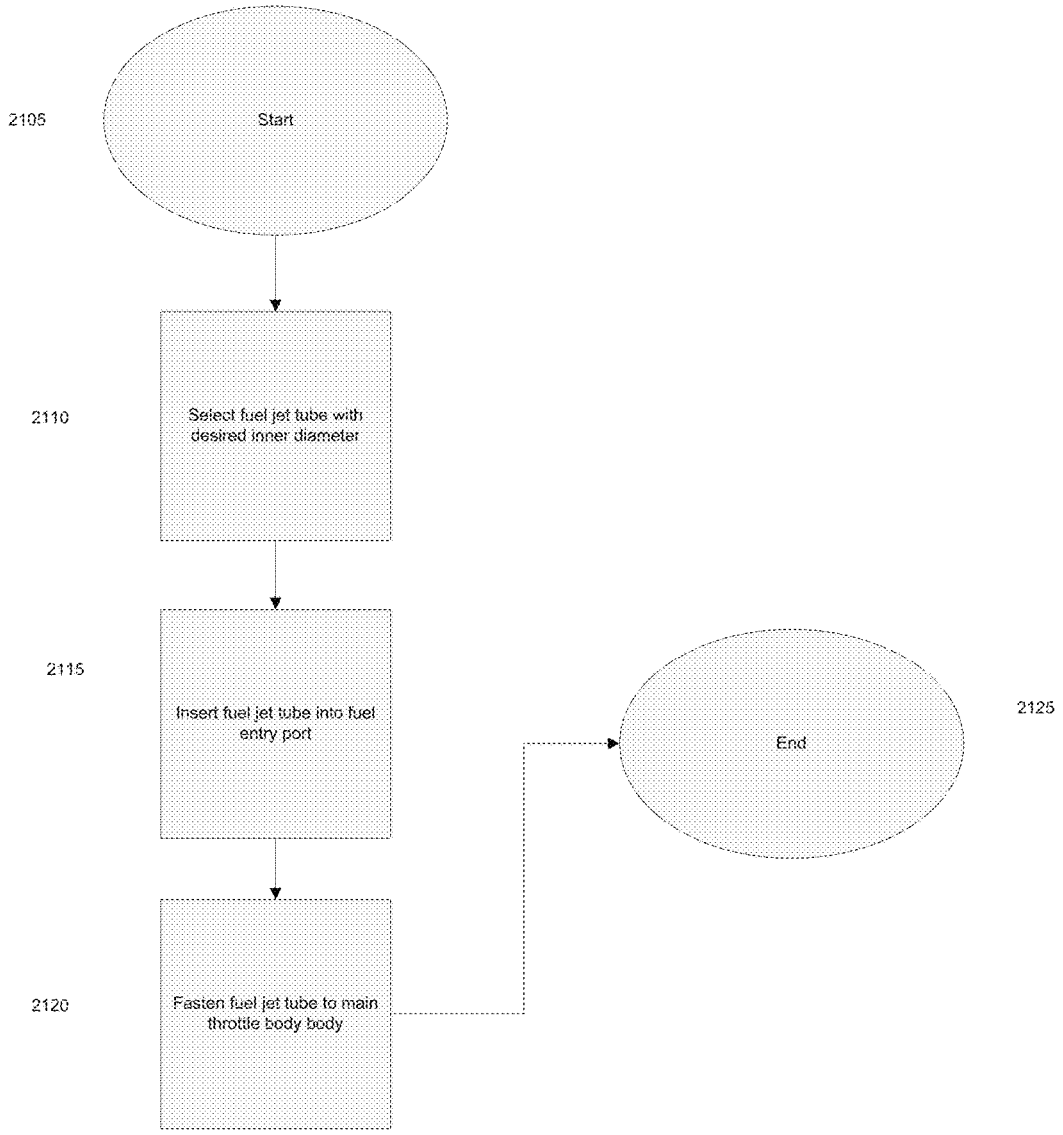
FIG. 21 is a flow chart illustrating a method of installing a fuel jet tube in a throttle body according to an embodiment of the present invention.

Another exemplary method of installing a fuel jet tube is illustrated in FIG. 21. The method starts at block 2105. The fuel jet tube of the desired final inner tube diameter is selected at block 2110. The selected fuel jet tube 30 is then inserted at least partially into the fuel entry port at block 2115. Once inserted into the fuel entry port, the fuel jet tube is fastened to the main throttle body at block 2120. The method ends at block 2125.

Figure 22:
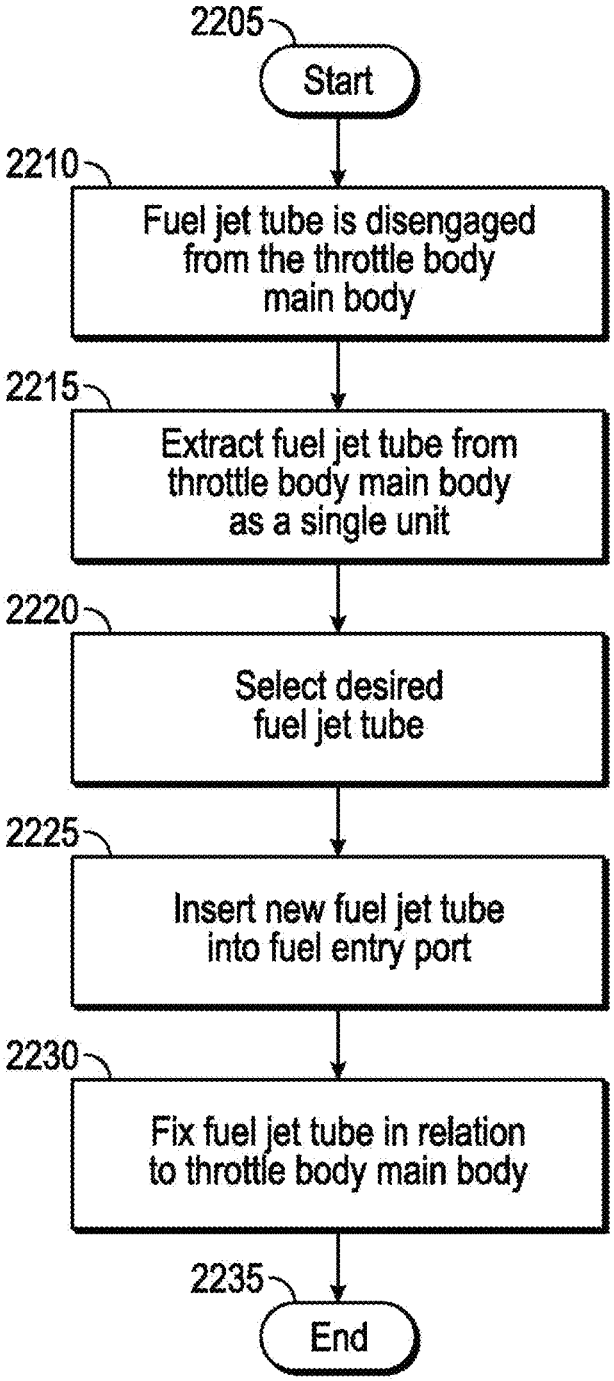
FIG. 22 is a flow chart illustrating a method of changing a fuel jet tube in a throttle body according to an embodiment of the present invention.

An exemplary method of changing out fuel jet tubes is illustrated in FIG. 22. The method starts at block 2205. The current fuel jet tube is unfastened from the throttle body main body at block 2210. The fuel jet tube is then extracted from the throttle body main body as a single unit at block 2215. A new fuel jet tube of the desired internal diameter and/or any other characteristics is selected at block 2220. The selected fuel jet tube is then inserted at least partially into the fuel entry port at block 2225. Once inserted into the fuel entry port, the fuel jet tube is fixed relative to the main throttle body at block 2230. The method ends at block 2235.

Figure 23:
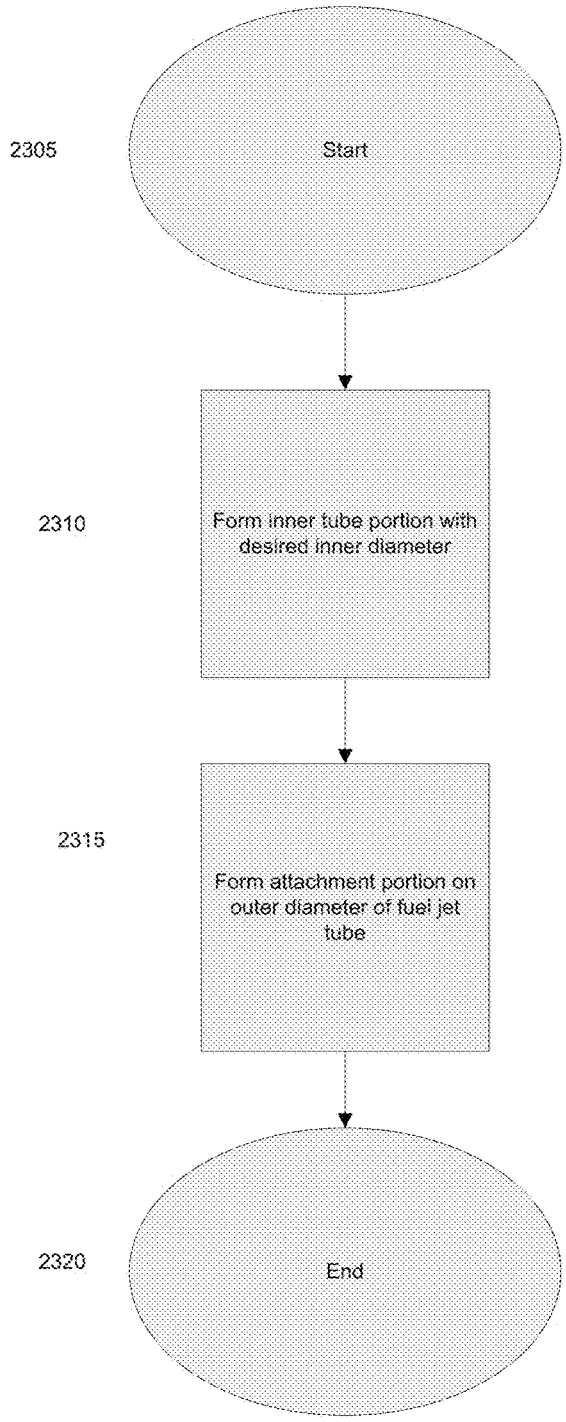
FIG. 23 is a flow chart illustrating a method for manufacturing a removable fuel jet tube according to an embodiment of the present invention.

An exemplary method of manufacturing a fuel jet tube is illustrated in FIG. 23. The method starts at block 2305, a desired inner diameter of the fuel jet tube is formed at block 2310, and the outer diameter of the fuel jet tube is then machined to the desired shape using a reduction process at block 2315. The method ends at block 2320. The order of method steps 2310 and 2315 may be interchangeable depending on manufacturing preferences.

Figure 24:
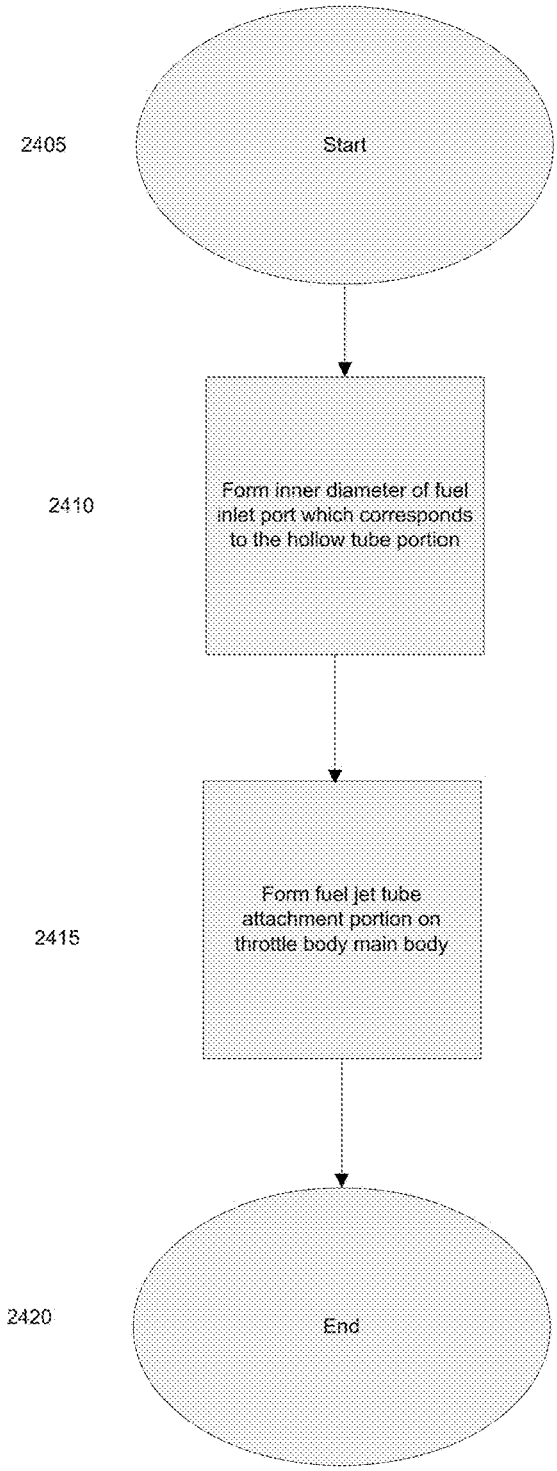
FIG. 24 is a flow chart illustrating a method of manufacturing or retrofitting a throttle body main body to fit a removable fuel jet tube according to an embodiment of the present invention.

An exemplary method of manufacturing, or retrofitting, a throttle body main body to be compatible with a fuel jet tube is illustrated in FIG. 24. The method starts at block 2405. A desired inner diameter for the fuel inlet port at the hollow tube portion is formed at block 2410. The desired attachment portion (e.g., threads) is formed so as to attachably and detachably mate to the fastening portion of fuel jet tube at block 2415. The method ends at block 2420.

While the above embodiments have been directed to the fuel jet tube of a throttle body, the invention is not limited to such. Indeed, any of the fuel inlet tubes, such as a tube suitable for insertion into aperture 110, may be made as removable fuel jet tubes with similar characteristics to those recited above.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the description of the invention. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A fuel tube system comprising:

a tube, having an outer diameter and a length, further comprising a proximal tube portion adjacent to the fastening portion and a distal tube portion opposite the proximal tube portion, wherein the distal tube portion has an outer diameter smaller than an outer diameter of the proximal tube outer diameter;

a fastening portion connected to and extending outwardly from the tube, the fastening portion having an outer diameter larger than the outer diameter of the distal tube portion and proximal tube portion, wherein the fastening portion further comprises an abutment face having a first abutment end with an outer diameter that is substantially similar to the outer diameter of the fastening portion and a second abutment end with an outer diameter that is substantially similar to the outer diameter of the tube, wherein the second abutment end is disposed adjacent to the tube, the abutment face angling away from the tube and extending to the second abutment end;

a first threaded portion disposed on the outer diameter of the fastening portion; and a tool connecting surface provided by a plurality of tool engagement grooves formed on an end of the fastening portion;

wherein the first threaded portion extends from adjacent to a bottom portion of at least one of the plurality of tool engagement grooves.

2. The fuel tube system of claim 1 further comprising one or more apertures disposed on the length of the tube.

3. The fuel tube system of claim 1 wherein the tube includes an end opposite from the fastening portion that is sealed.

4. The fuel tube system of claim 1 wherein the tube includes an end opposite from the fastening portion having an angled face.

5. The fuel tube system of claim 1 further comprising a tube alignment marker disposed on the fastening portion configured to align with a body alignment marker disposed on an attachment surface.

6. A fuel tube system comprising:

a tube, having a length, further comprising a proximal tube portion adjacent to the fastening portion and a distal tube portion opposite the proximal tube portion, wherein the distal tube portion has an outer diameter smaller than an outer diameter of the proximal tube outer diameter;

a fastening portion connected to and extending outwardly from the tube, the fastening portion having an outer diameter larger than the outer diameter of the proximal tube portion and the distal tube portion, wherein the fastening portion further comprises an abutment face having a first abutment end with an outer diameter that is substantially similar to the outer diameter of the fastening portion and a second abutment end with an outer diameter that is substantially similar to the outer diameter of the proximal tube portion, wherein the second abutment end is disposed adjacent to the proximal tube portion, the abutment face angling away from the proximal tube portion and extending to the second abutment end;

a first threaded portion disposed on the outer diameter of the fastening portion;

a plurality of tool engagement grooves formed on an end of the fastening portion;

one or more apertures disposed on the length of the tube; and a tube alignment marker disposed on the fastening portion configured to align with a body alignment marker disposed on an attachment surface.

7. The fuel tube system of claim 6 wherein the first threaded portion extends from adjacent to a bottom portion of at least one of the plurality of tool engagement grooves; and wherein the distal tube portion has a sealed end with an angled face opposite from the fastening portion.

8. The fuel tube system of claim 6 wherein the tube is configured to extend into a booster assembly disposed within a chamber disposed within a throttle body main body.

* * * * *